US010258853B2

(12) United States Patent
Hsiao

(10) Patent No.: US 10,258,853 B2
(45) Date of Patent: Apr. 16, 2019

(54) GOAL FRAME

(71) Applicant: SHANGHAI YING KUN SPORTING GOODS CO., LTD., Shanghai (CN)

(72) Inventor: Liang Lang Hsiao, Changhua County (TW)

(73) Assignee: Shanghai Ying Kun Sporting Goods Co., Ltd., Shanghai (CN)

( * ) Notice: Subject to any disclaimer, the term of this patent is extended or adjusted under 35 U.S.C. 154(b) by 54 days.

(21) Appl. No.: 15/701,609

(22) Filed: Sep. 12, 2017

(65) Prior Publication Data

US 2019/0076711 A1 Mar. 14, 2019

(51) Int. Cl.
*A63B 63/00* (2006.01)

(52) U.S. Cl.
CPC ..... *A63B 63/004* (2013.01); *A63B 2063/005* (2013.01); *A63B 2210/50* (2013.01)

(58) Field of Classification Search
CPC ..... A63B 2063/005; A63B 63/004
USPC ..... 403/65, 95, 471, 195, 197
See application file for complete search history.

(56) References Cited

U.S. PATENT DOCUMENTS 3,195,898 A * 7/1965 Respini ..... A63B 63/00 135/118
5,681,045 A * 10/1997 Liao ..... A63B 63/004 273/400
5,839,733 A * 11/1998 Meeks ..... A63B 63/004 273/400
7,270,608 B2 * 9/2007 Cho ..... A63B 71/022 273/400
2004/0036222 A1 * 2/2004 Chou ..... A63B 63/004 273/407
2005/0227794 A1 * 10/2005 Bouffard ..... A63B 69/0097 473/478
2007/0281805 A1 * 12/2007 Hsiao ..... A63B 63/004 473/407
2009/0062026 A1 * 3/2009 Cho ..... A63B 63/00 473/194
2016/0263455 A1 * 9/2016 Holland ..... A63B 63/004

FOREIGN PATENT DOCUMENTS

TW M266087 6/2005
TW M300127 11/2006

* cited by examiner

*Primary Examiner* — Melba Bumgarner
*Assistant Examiner* — Rayshun Peng
(74) *Attorney, Agent, or Firm* — Rosenberg, Klein & Lee

(57) ABSTRACT

A goal frame includes a frame. The frame is mounted with a ball net to form a goal when the frame is in an unfolded state. The frame includes support members, at least one connecting member, and posts. The support members are pivotally connected to the connecting member. The connecting member has stop portions corresponding to the support members. When the support members are blocked by the stop portions, the frame is in the unfolded state. When in the unfolded state, the posts are mounted to the support members, respectively. The posts are detachable. The support members are limited by the ball net and the corresponding stop portions to retain the goal frame in the unfolded state. The assembly of the goal frame is simply. The goal frame can be folded quickly and conveniently by pivoting the support members. The cost of the components is low.

5 Claims, 13 Drawing Sheets

GOAL FRAME

FIELD OF THE INVENTION

The present invention relates to a ball game apparatus, and more particularly to a goal frame.

BACKGROUND OF THE INVENTION

Taiwan Patent Publication No. TW M266087 discloses a "retractable folding goal structure". When in use, the goal structure is unfolded and provided with a ball net. The goal structure includes many inner and outer pipes, an adjustment assembly (60) and a folding assembly (30). To assemble the goal structure, the inner pipes are insertedly connected to the outer pipes and connected with the adjustment assembly (60) and the folding assembly (30). The components are complicated, and the assembly is inconvenient. Moreover, when the folding assembly (30) is folded (as shown in FIG. 6 thereof), only the height is reduced and the width remains the original size, so that the size that can be reduced is limited.

Taiwan Patent Publication No. TW M300127 discloses a "foldable goal frame". The goal frame comprises posts (20) provided with pivot members (3). Although the posts (20) can be pivotally folded to reduce the size, the pivot members (3) need to cooperate with sleeves (130) of a fixing sleeve assembly (13) for positioning. The cost of the components is high. The assembly and disassembly is inconvenient because there are many pivot members (3).

SUMMARY OF THE INVENTION

The primary object of the present invention is to solve the aforesaid problems and to provide a goal frame which is constituted by a simple structure of a connecting member, a plurality of supporting members and a plurality of posts. When in use, the goal frame is provided with a ball net to form a goal, and the plurality of support members can be unfolded quickly. Through the ball net set between the posts, the plurality of posts can be tensioned by the ball net, that is, the tension of the ball net is used to retain the goal frame in the unfolded state, without the need of additional fixing components. The assembly of the goal frame is simply. The goal frame can be folded quickly by pivoting the plurality of support members. The cost of the components is low. The goal frame can be folded and unfolded quickly, which is convenient for use.

In order to achieve the aforesaid object, the goal frame of the present invention comprises a frame. The frame is provided with a ball net to form a goal when the frame is in an unfolded state. The frame comprises a plurality of support members, at least one connecting member, and a plurality of posts. The plurality of support members are pivotally connected to the at least one connecting member. The at least one connecting member has stop portions corresponding to the plurality of support members. When the plurality of support members are blocked by the stop portions, the frame is in the unfolded state. When in the unfolded state, the plurality of posts are mounted to the plurality of support members respectively. The plurality of posts are detachable. The plurality of support members are limited by the ball net and the corresponding stop portions to maintain and retain the unfolded state.

DETAILED DESCRIPTION OF THE PREFERRED EMBODIMENTS

Embodiments of the present invention will now be described, by way of example only, with reference to the accompanying drawings. The inventive concept may, however, be embodied in many different forms and should not be construed as being limited to the embodiments set forth herein.

Throughout the description of the present disclosure, spatially relative terms, such as "inner," "outer," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. It will be understood that, although the terms "first," "second" etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

As shown in FIG. 1 to FIG. 13, a goal frame in accordance with a preferred embodiment of the present invention comprises a connecting member 1, two support members 2, and two posts 3. When in use, the goal frame is unfolded and provided with a ball net 4 to from a goal.

Figure 2:
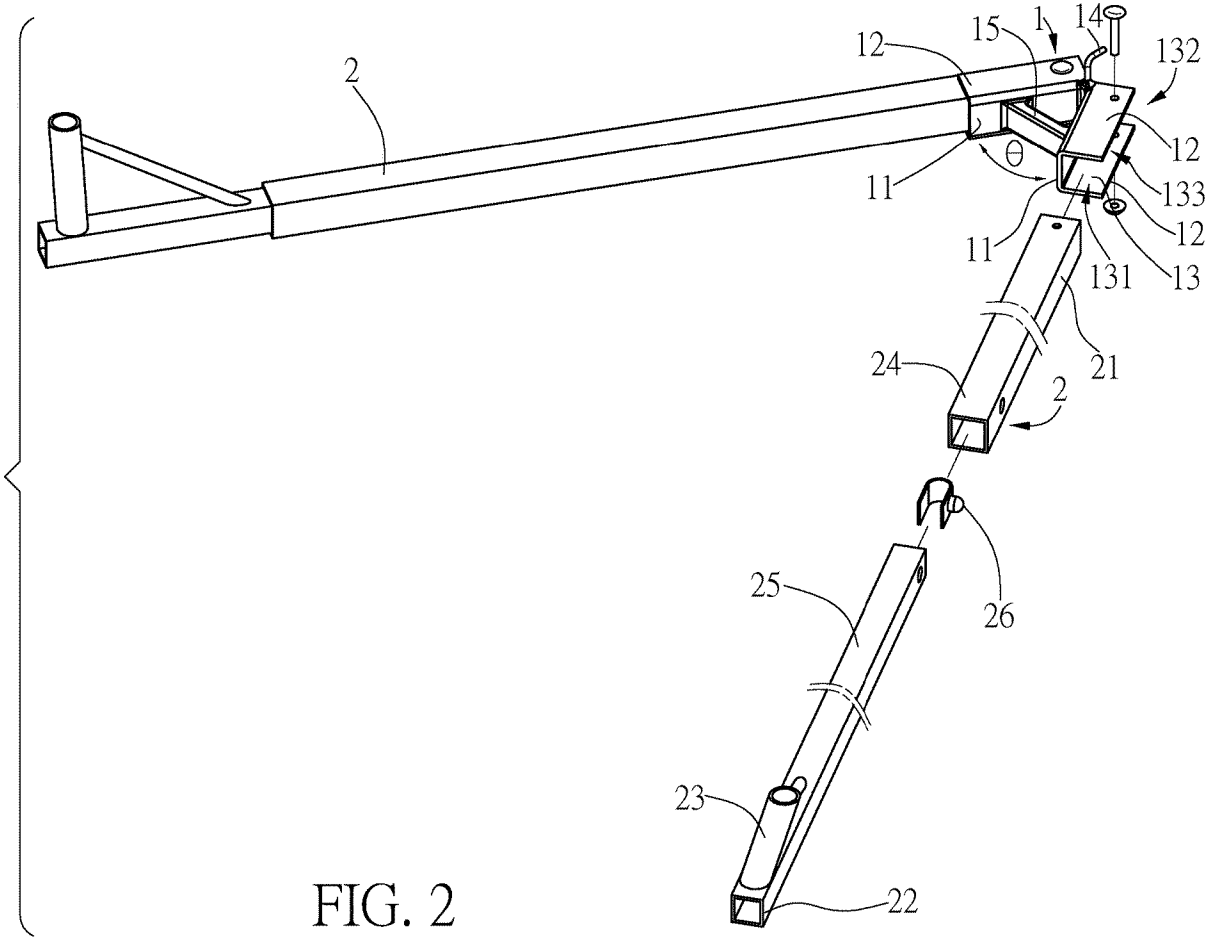
FIG. 2 is an exploded view of the goal frame in accordance with the first embodiment of the present invention.

As shown in FIG. 2, the connecting member 1 has two base plates 11. Inner ends of the two base plates 11 are fixedly connected to each other, and outer ends of the two base plates 11 are gradually opened at an angle θ. Two opposite sides of each base plate 11 has two side plates 12 extending outward. Each base plate 11 and the two side plates 12 jointly define a groove 13 therebetween. The groove 13 has a first open end 131 and a second open end 132 at two ends thereof. The first open ends 131 of the grooves 13 of the two base plates 11 are away from each other. The second open ends 132 of the grooves 13 of the two base plates 11 are close to each other. The groove 13 has an open side 133 opposite to the base plate 11. In this embodiment, the inner end of the connecting member 1 is provided with a hook 14. The hook 14 is configured to hook and position the ball net 4.

Figure 3:
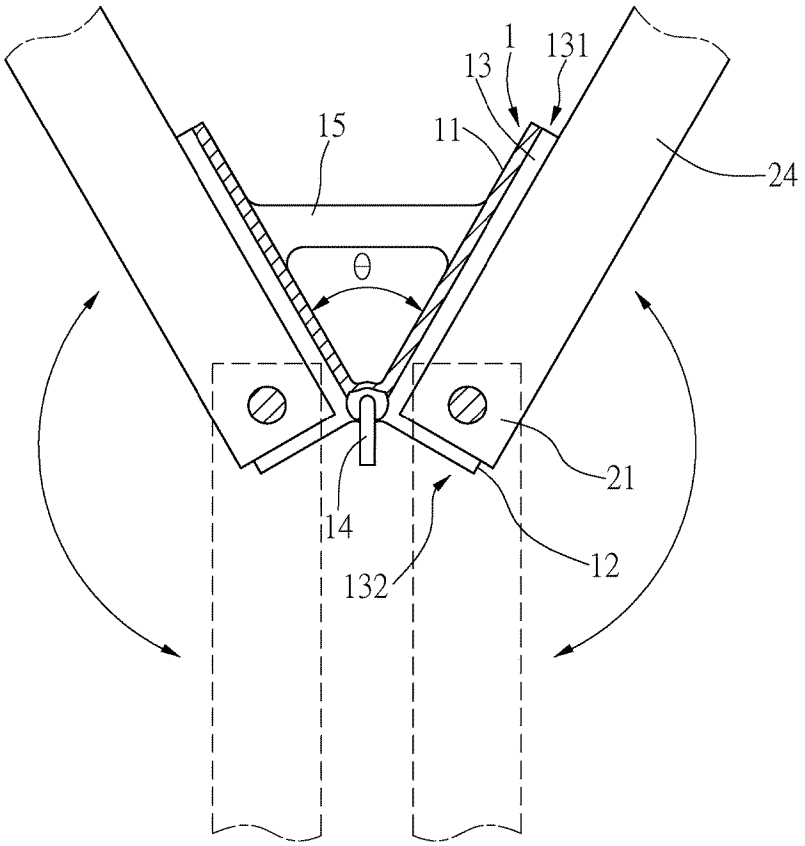
FIG. 3 is a schematic view in accordance with the first embodiment of the present invention, showing that the two support members are pivoted relative to the connecting member.

As shown in FIG. 2, the two support members 2 each have a first end 21 and a second end 22 at two ends thereof. The first end 21 is pivotally connected to the side plates 12 at two sides of the groove 13. Each support member 2 is pivotable between the first open end 131 and the second open end 132 via the open side 133. As shown in FIG. 2 and FIG. 3, the two support members 2 can be pivoted toward the respective first open ends 131 and blocked by the respective base plates 11. At this time, the two support members 2 cannot be moved closer to each other and extend along the included angle θ to be in an unfolded state. Or, the two support members 2 can be pivoted toward the respective second open ends 132. Because the two second open ends 132 are relatively close to each other, the two support members 2 are pivoted to approach each other to be in a folded state.

Figure 1:
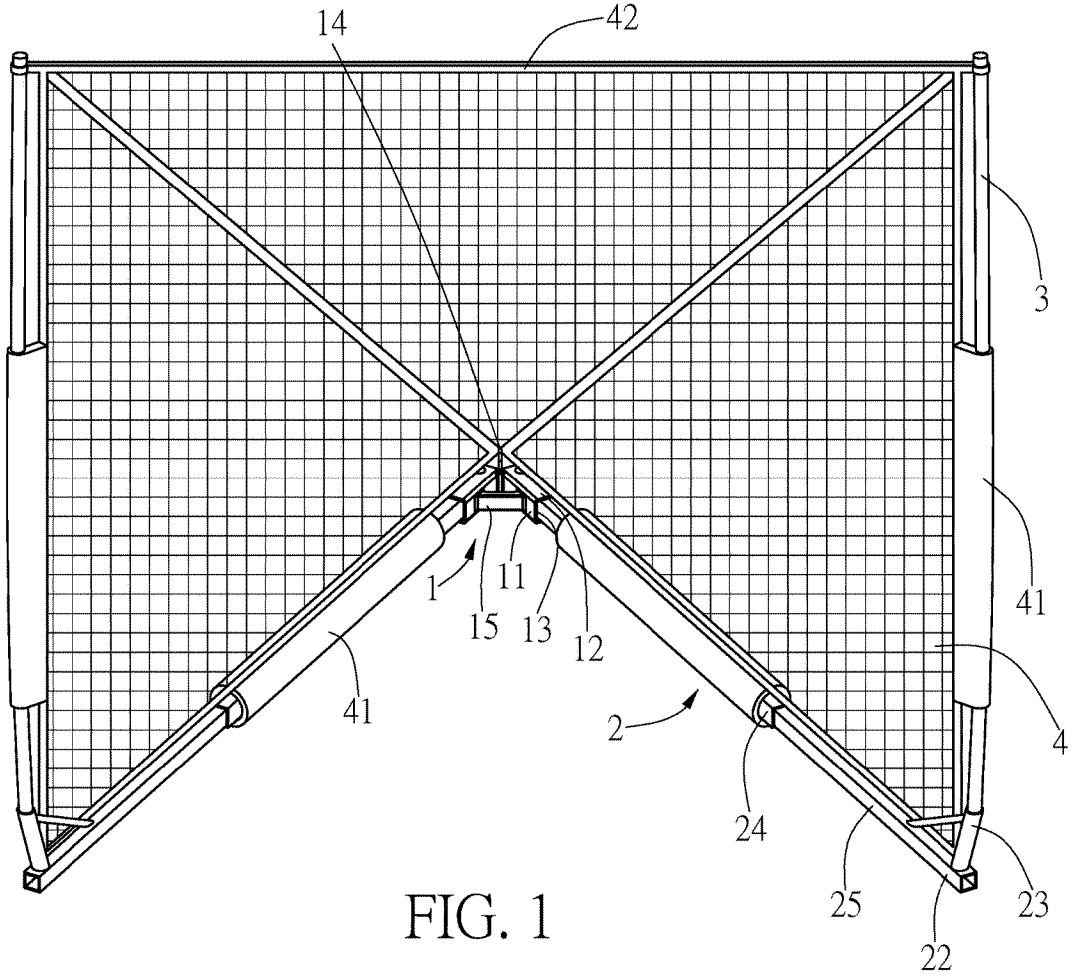
FIG. 1 is a perspective view in accordance with a first embodiment of the present invention, showing that the goal frame is provided with the ball net to form the goal.

As shown in FIG. 1, when the two support members 2 are pivoted toward the respective first open ends 131 and blocked by the respective base plates 11 and extend along the included angle θ, the two posts 3 are located at the second ends 22 of the support members 2. The two posts 3 are tensioned when the ball net 4 is set so as to retain the spacing between the second ends 22 of the two support members 2. In this embodiment, the ball net 4 may be used to tension the two posts 3 and to retain the spacing between the second ends 22 of the two support members 2. In this embodiment, the ball net 4 is provided with a plurality of sleeves 41 fitted on the two support members 2 and the two posts 3. The ball net 4 is provided with an edge strip 42 between the top ends of the two posts 3. The edge strip 42 is located between the top ends of the two posts 3 to tension the two posts 3 so that the spacing between the second ends 22 of the two support members 2 is retained.

Figure 4:
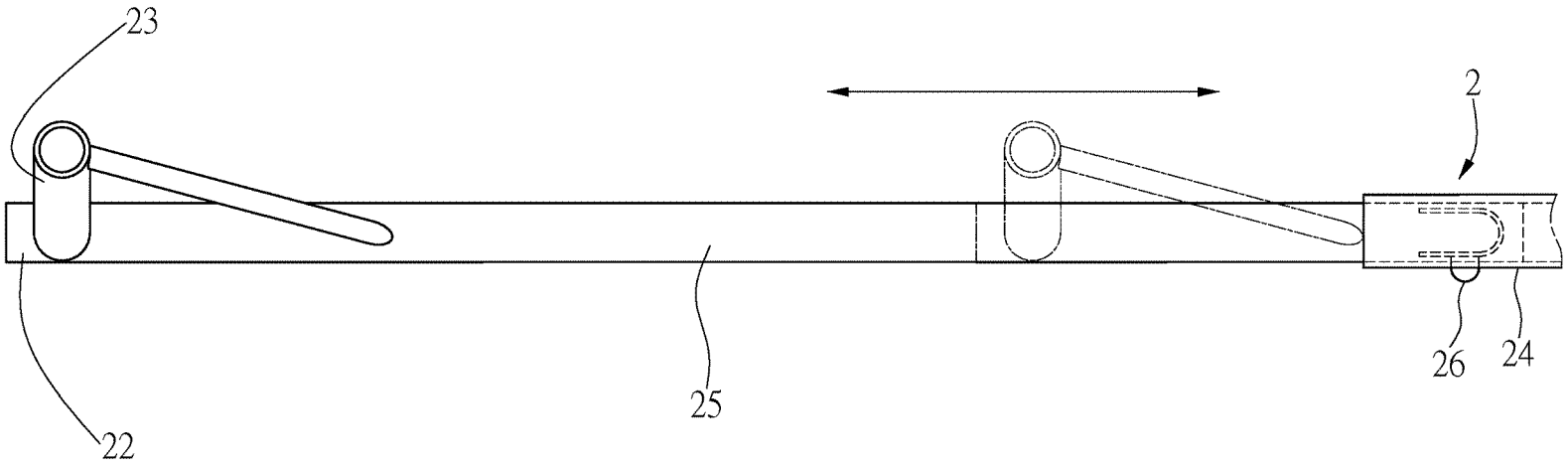
FIG. 4 is a schematic view in accordance with the first embodiment of the present invention, showing that the inner rod of the support member is extendable relative to the outer pipe.

As shown in FIG. 1 to FIG. 2, the second end 22 of each support member 2 of this embodiment is provided with an upright pipe 23. Each post 3 is inserted in the upright pipe 23 to stand at the second end 22 of the corresponding support member 2. As shown in FIG. 4, each support member 2 of this embodiment has an outer pipe 24 and an inner rod 25. The inner rod 25 is inserted from one end of the outer pipe 24 and is retractable. The outer pipe 24 and the inner rod 25 are positioned by a positioning member 26 when extended. In this embodiment, when the support members 2 are in the unfolded state, the inner rods 25 are extended relative to the outer pipes 24 for the depth of the goal. When the support members 2 are in the folded state, the inner rods 25 are retracted relative to the outer pipes 24 so that the length of the support members 2 are shortened to be folded easily.

Figure 5:
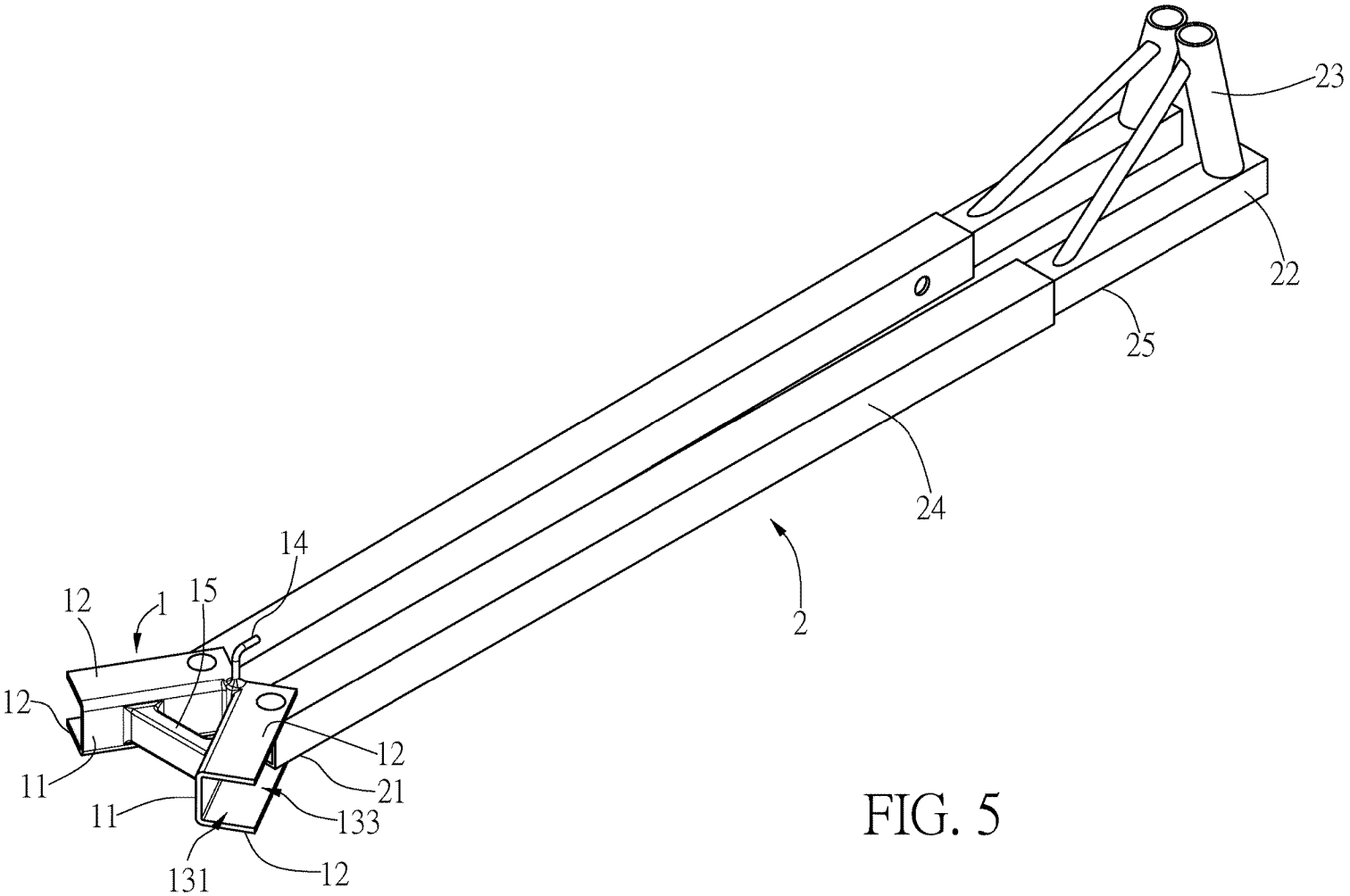
FIG. 5 is a schematic view in accordance with the first embodiment of the present invention, showing that the goal frame is in a folded state.

When the goal frame of the aforesaid embodiment is mounted with the ball net 4 to form a goal, the two support members 2 are pivoted toward the respective first open ends 131 until the two support members 2 are blocked by the respective base plates 11. The two support members 2 are extended along the inclined angle θ of the two base plates 11 of the connecting member 1. When the ball net 4 is mounted, the two posts 3 are tensioned and the spacing between the second ends 22 of the two support members 2 is retained. As shown in FIG. 1, the ball net 4 is set and opened to form the goal. When the user wants to fold the goal frame, the ball net 4 is first detached from the gold frame, and then the two support members 2 are pivoted toward the respective second open ends 132 of the connecting member 1 as shown in FIG. 3 until the two support members 2 are mutually close to each other to be in the folded state, as shown in FIG. 5.

According to the above explanation, the present invention has some advantages. The goal frame is constituted by the simple structure of the connecting member 1, the two support members 2, and the two posts 3. When the ball net 4 is to be mounted, the two support members 2 are pivoted to be unfolded quickly. The two posts 3 are tensioned by the ball net 4 so that the spacing between the second ends 22 of the two support members 2 can be retained, without the need for additional fixing elements. When the goal frame is to be folded, the two support members 2 can be pivoted and folded quickly. Compared with the conventional goal structure, the assembly of the present invention is simply, and the cost of the components is low. The goal frame can be folded and unfolded quickly, which is convenient for use.

Of course, the present invention may have many examples with only minor modifications therebetween. Referring to FIG. 6 to FIG. 13, a second embodiment of the present invention comprises a main rod 5, two support members 6, and four posts 7, 8. When in use, the goal frame is unfolded and mounted with a ball net 9 to form a goal.

Figure 6:
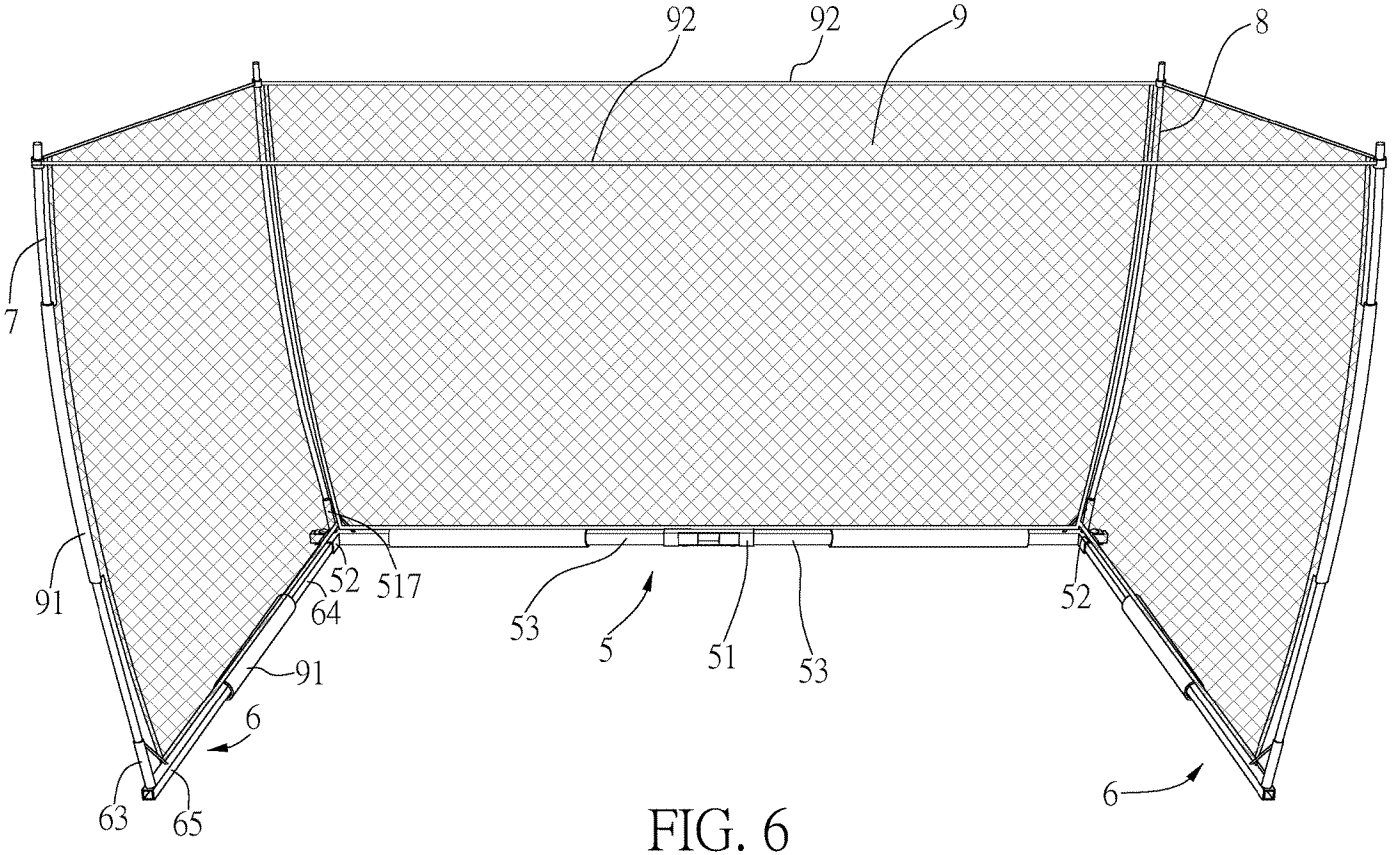
FIG. 6 is a perspective view in accordance with a second embodiment of the present invention, showing that the goal frame is provided with the ball net to form the goal.
Figure 7:
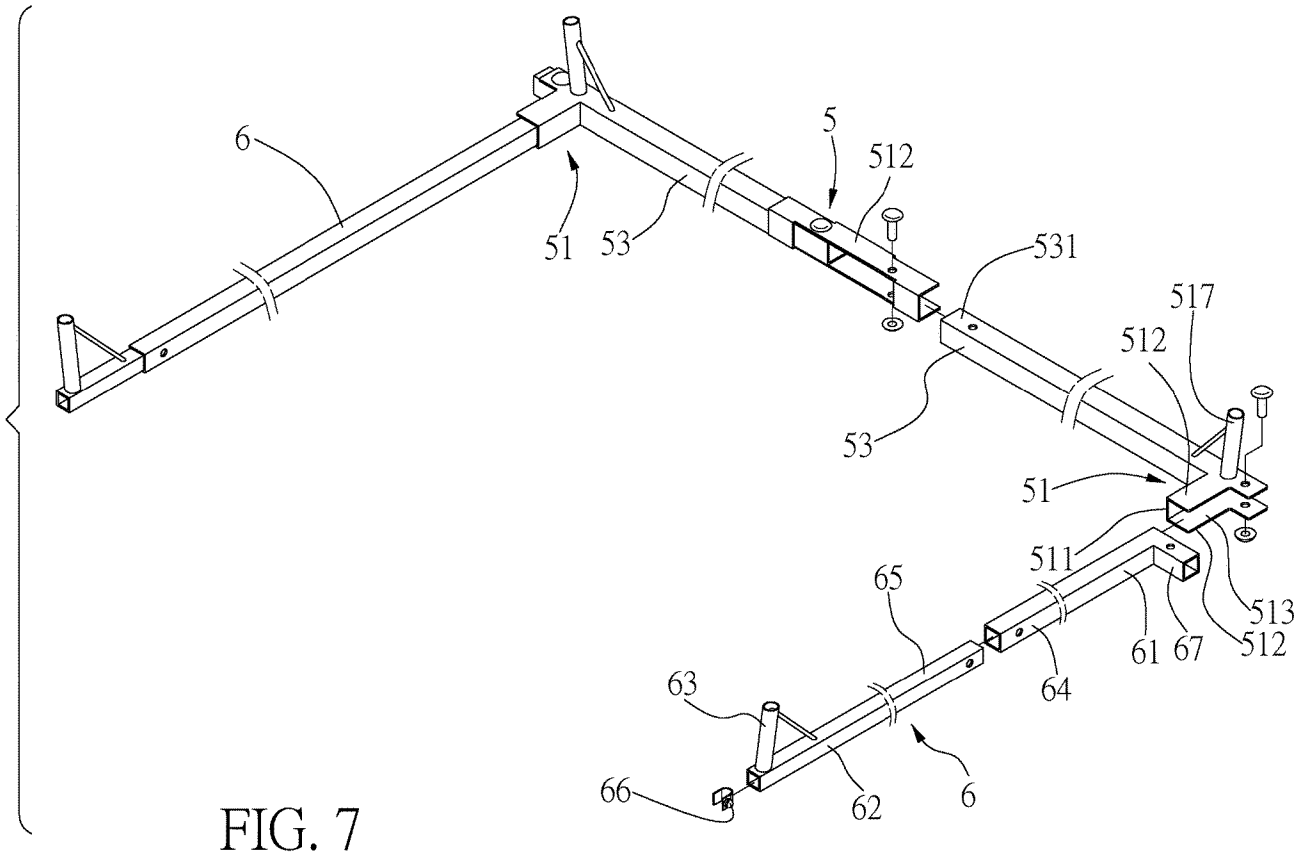
FIG. 7 is an exploded view of the goal frame in accordance with the second embodiment of the present invention.
Figure 8:
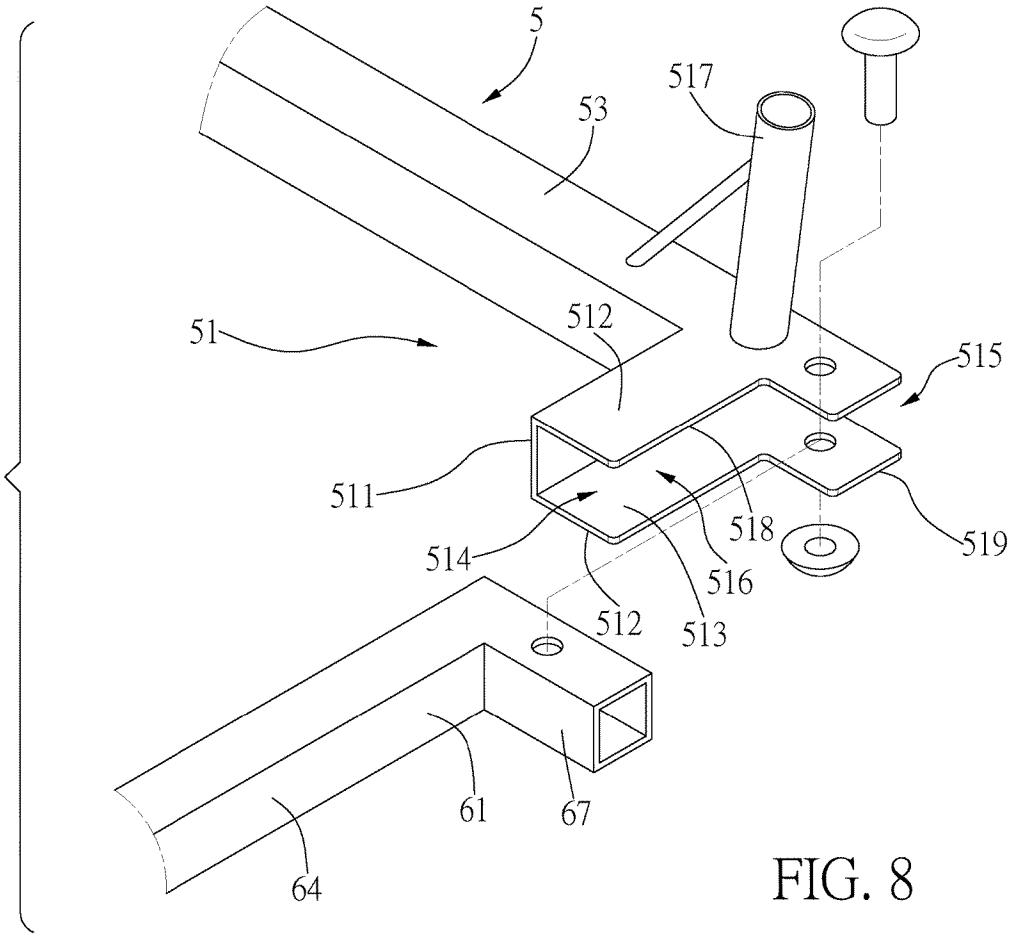
FIG. 8 is a schematic view in accordance with the second embodiment of the present invention, showing the pivotal connection of the support member and the pivot seat.

As shown in FIG. 6 to FIG. 7, the main rod 5 is in the form of a straight strip when a goal is formed. The main rod 5 has pivot seats 51 at two opposite ends thereof. As shown in FIG. 7 to FIG. 8, each of the pivot seats 51 has a base plate 511 and two side plates 512. The base plate 511 is perpendicular to the longitudinal direction of the main rod 5. The two side plates 512 are disposed at two opposite sides of the base plate 511 and extend outwardly, respectively. Each base plate 511 and the two side plates 512 jointly define a groove 513 therebetween. The groove 513 has a first open end 514 and a second open end 515 at two ends thereof. The groove 513 has an open side 516 opposite to the base plate 511.

Figure 9:
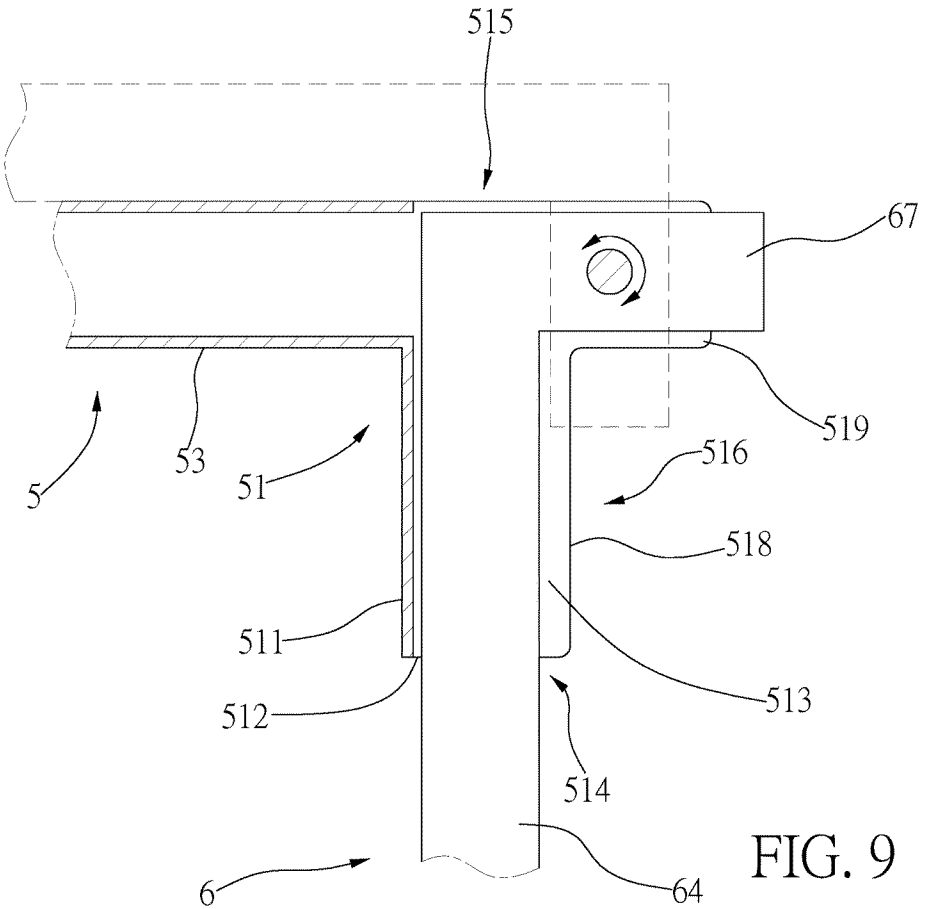
FIG. 9 is a schematic view in accordance with the second embodiment of the present invention, showing that the support member is pivoted relative to the pivot seat.

As shown in FIG. 7 to FIG. 8, the two support members 6 each have a first end 61 and a second end 62 at two ends thereof. The first end 61 is pivotally connected to the side plates 512 at two sides of the groove 513. Each support member 6 is pivotable between the first open end 514 and the second open end 515 via the open side 516. As shown in FIG. 9, the two support members 6 are pivoted toward the respective first open ends 514 and blocked by the respective base plates 511. At this time, the two support members 6 are extended in the vertical direction of the main rod 5 to be in the unfolded state. Or, the two support members 6 are pivoted toward the respective second open ends 515 until the two support members 6 are aligned with the longitudinal direction of the main rod 5 to be in the folded state.

As shown in FIG. 6, when the two support members 6 are pivoted toward the respective first open ends 514 to be blocked by the respective base plates 511 to extend in the vertical direction of the main rod 5, two front posts 7 are located at the second ends 62 of the two support members 6 respectively, and two rear posts 8 are located at the first ends 61 of the two support members 6 respectively. The front posts 7 are tensioned when the ball net 9 is set, and the spacing of the second ends 62 of the two support members 6 is retained.

In this embodiment, the ball net 9 may be used to tension the two front posts 7 and to retain the spacing between the second ends 62 of the two support members 6. In this embodiment, the ball net 9 is provided with a plurality of sleeves 91 fitted on the main rod 5, the two support members 6, and the four posts 7, 8. The ball net 9 is provided with an edge strip 92 between the top ends of the two front posts 7. The edge strip 92 is located between the top ends of the two front posts 7 to tension the two front posts 7 so that the spacing between the second ends 62 of the two support members 6 is retained.

As shown in FIG. 6 to FIG. 7, the second end 62 of each support member 6 is provided with a front upright pipe 63. Each of the pivot seats 51 at the two ends of the main rod 5 is provided with a rear upright pipe 517. The two front posts 7 are inserted in the front upright pipes 63 of the two support members 6 to stand at the second ends 62 of the two support members 6. The two rear posts 8 are inserted in the rear upright pipes 517 of the two pivot seats 51 to stand at the first ends 61 of the two support members 6.

Figure 10:
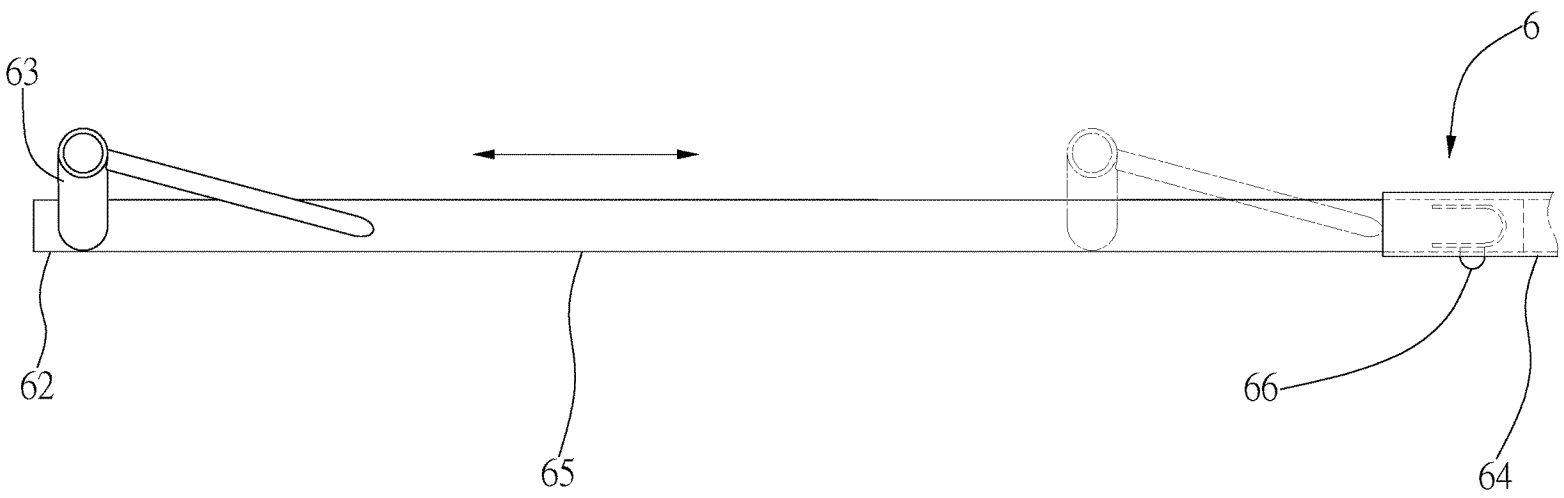
FIG. 10 is a schematic view in accordance with the second embodiment of the present invention, showing that the inner rod of the transverse rod is extendable relative to the outer pipe.

As shown in FIG. 7 and FIG. 10, each support member 6 of this embodiment has an outer pipe 64 and an inner rod 65. The inner rod 65 is inserted from one end of the outer pipe 64 and is retractable. The outer pipe 64 and the inner rod 65 are positioned by a positioning member 66 when extended. In this embodiment, when the support members 6 are in the unfolded state, the inner rods 65 are extended relative to the outer pipes 64 for the depth of the goal. When the support members 6 are in the folded state, the inner rods 65 are retracted relative to the outer pipes 64 so that the length of the support members 6 are shortened to be folded easily.

Figure 11:
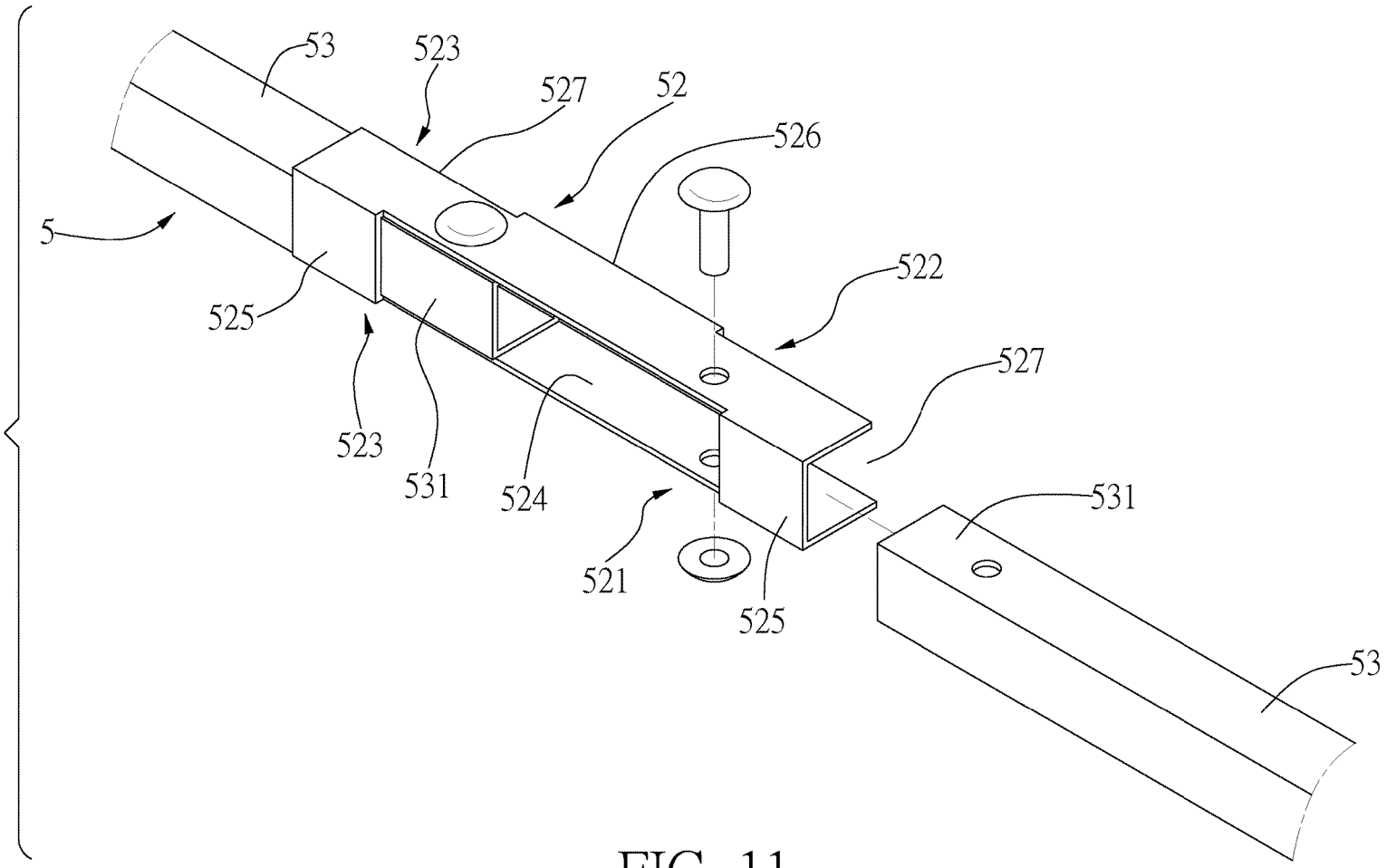
FIG. 11 is a schematic view in accordance with the second embodiment of the present invention, showing the pivotal connection of the two transverse rods and the connecting seat.
Figure 12:
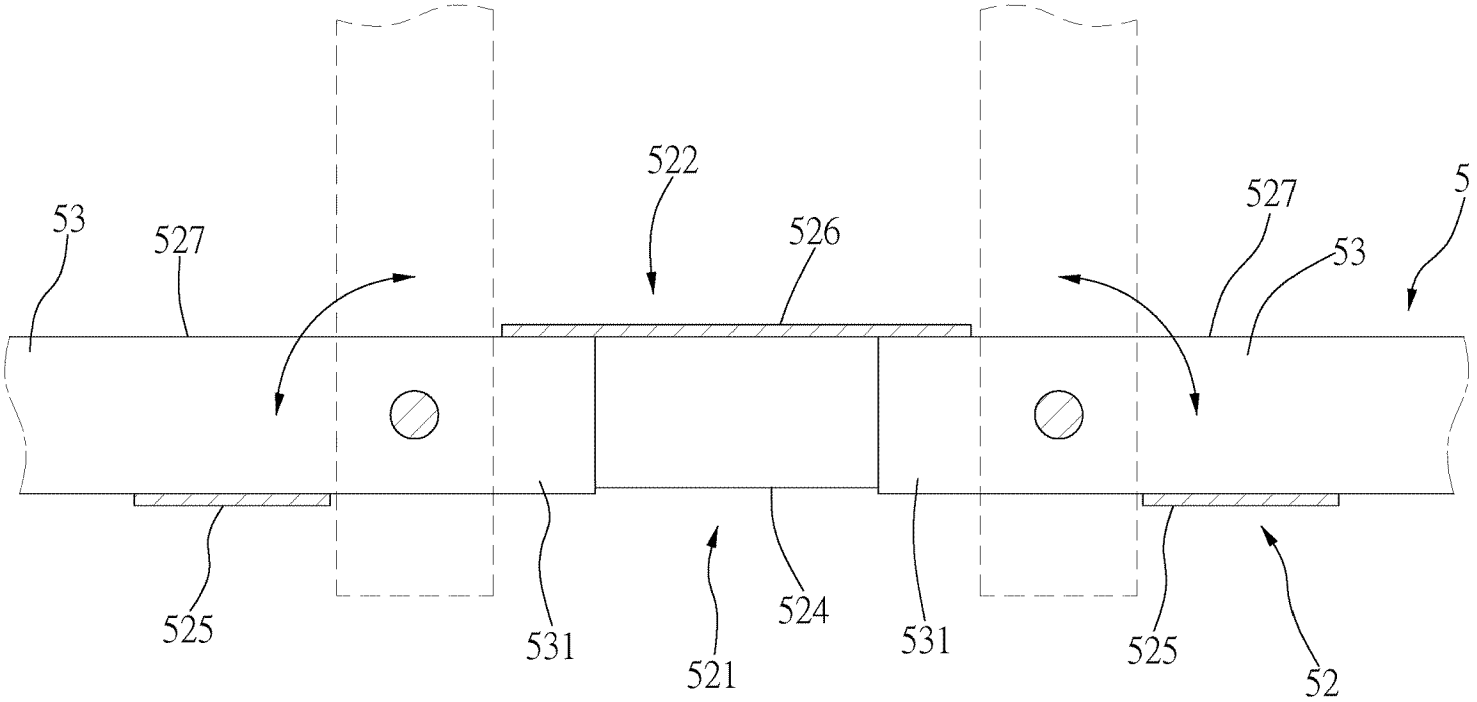
FIG. 12 is a schematic view in accordance with the second embodiment of the present invention, showing that the two transverse rods are pivoted relative to the connecting seat.

As shown in FIG. 7 and FIG. 12, the main rod 5 of this embodiment has a connecting seat 52 and two transverse rods 53. The connecting seat 52 has a rectangular tubular shape, and two opposite first sides 521, 522 and two opposite second sides 523. The first side 521 has a first opening 524 at a central portion thereof and two first stop plates 525 close to two ends thereof. The first side 522 has a second stop plate 526 at a central portion thereof and two second openings 527 close to two ends thereof. As shown in FIG. 11 to FIG. 12, one end of each transverse rod 53 has the pivot seat 51, and another end of each transverse rod 53 has a pivot end 531. The pivot end 531 of each transverse rod 53 is inserted into the connecting seat 52 from the second opening 527 and is pivotally connected to the two second sides 523 and slightly extends beyond the first opening 524. The two transverse rods 53 are pivoted to be parallel to the longitudinal direction of the connecting seat 52, and the two transverse rods 53 are blocked by the first stop plates 525 to be in the form of the aforesaid straight strip. Or, the transverse rods 53 are pivoted toward the same side of the connecting seat 52.

As shown in FIG. 8 to FIG. 9, each side plate 512 has an L-shape and has a long portion 518 and a short portion 519 which are connected to each other. The short portion 519 extends along the longitudinal direction of the main rod 5 from one side of the long portion 518, far away from the base plate 511. The first end 61 of each support member 6 has an L-shaped pivot block 67 corresponding to each side plate 512. The pivot block 67 of each support member 6 is pivotally connected between the short portions 519 of the two side plates 512 of each pivot seat 51. When the two support members 6 are pivoted toward the respective first open ends 514 and blocked by the respective base plates 511, the two support members 6 are extended in the vertical direction of the main rod 5 in the form of a straight strip. Or, when the two transverse rods 53 are pivoted toward the same side of the connecting seat 52, the two support members 6 are pivoted toward the respective second open ends 515 until the two support members 6 are aligned with the longitudinal direction of the two transverse rods 53.

Figure 13:
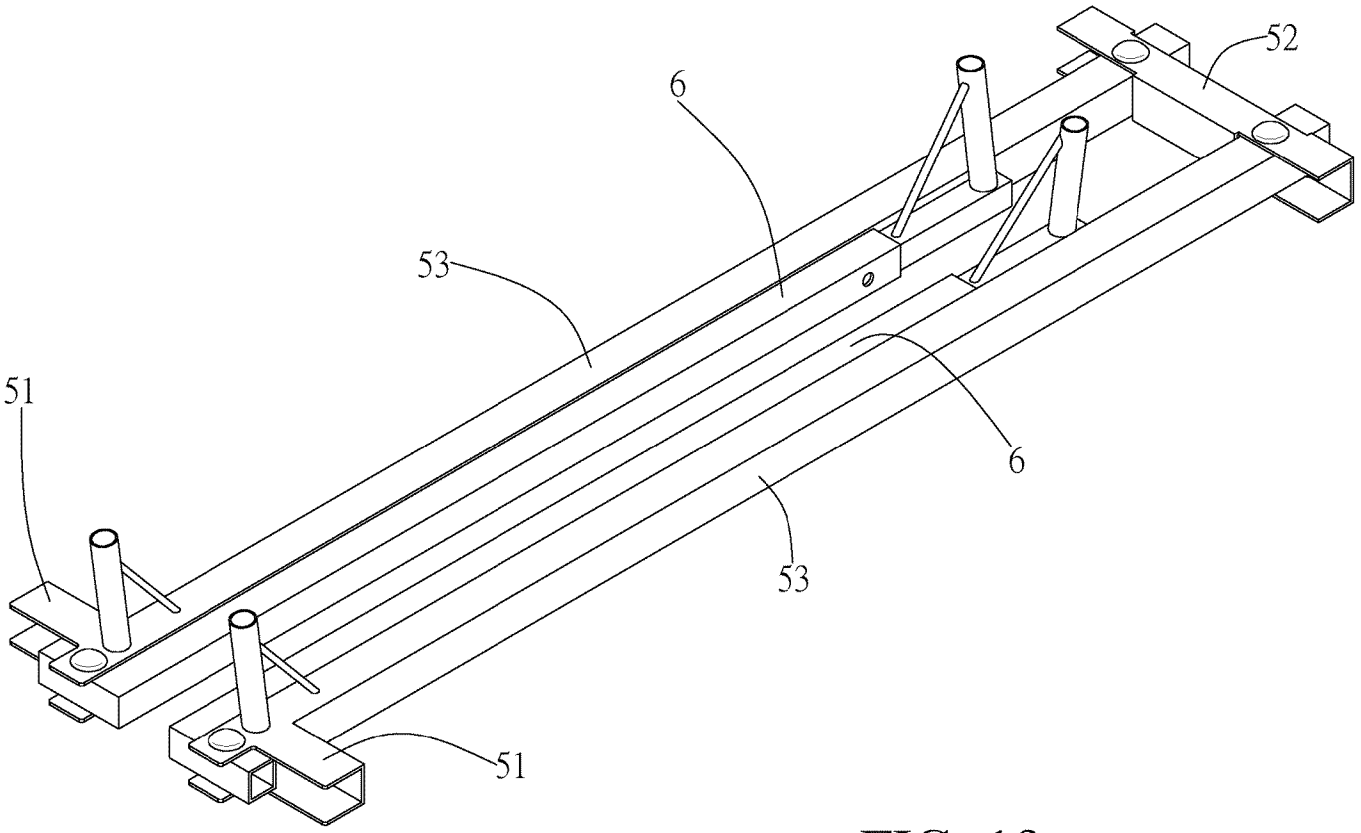
FIG. 13 is a schematic view in accordance with the second embodiment of the present invention, showing that the goal frame is in a folded state.

When the goal frame of the aforesaid embodiment is mounted with the ball net 9 to form a goal, the two transverse rods 53 are pivoted relative to the connecting seat 52 to unfold in the form of a straight strip, and the two support members 6 are pivoted from the pivot seats 51 toward the respective first open ends 514 until the two support members 6 are blocked by the respective base plates 511. The two support members 6 are extended along the two base plates 511 of the pivot seats 51 in the vertical direction of the main rod 5 to form a U shape. The two front posts 7 and the two rear posts 8 are inserted in the two front upright pipes 63 and the two rear upright pipes 517, respectively. When the ball net 9 is mounted, the two front posts 7 are tensioned and the spacing between the second ends 62 of the two support members 6 is retained. As shown in FIG. 6, the ball net 9 is set and opened to form the goal. When the user wants to fold the goal frame, the ball net 9 is first detached from the gold frame, and the inner rods 65 of the two support members 6 are retracted into the outer pipes 64, and then the two support members 6 are pivoted toward the respective second open ends 515 of the pivot seats 51 until the two support members 6 are aligned with the two transverse rods 53, and the transverse rods 53 are pivoted toward the same side of the connecting seat 52 to be in the folded state, as shown in FIG. 13.

The goal frame is constituted by the simple structure of the main rod 5, the two support members 6, and the four posts 7, 8. When the required length of the main rod is short, the main rod may be a rod without segmentation. When the ball net 9 is to be mounted, the two support members 6 are pivoted to be unfolded quickly. The two front posts 7 are tensioned by the ball net 9 so that the spacing between the second ends 62 of the two support members 6 can be retained without the need for additional fixing elements. When the goal frame is to be folded, the two support members 6 can be pivoted and folded quickly. When the required length of the main rod is long, the connecting seat 52 is pivotally connected with the two transverse rods 53. The two transverse rods 53 can be unfolded to be parallel to the connecting seat 52 in the form of a straight strip, and the two transverse rods 53 can be pivoted toward the same side of the connecting seat 52 to be unfolded and folded quickly. Compared with the conventional goal structure, the assembly of the present invention is simply, and the cost of the components is low. The goal frame can be folded and unfolded quickly, which is convenient for use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A goal frame, comprising a frame, the frame provided with a ball net to form a goal when the frame is in an unfolded state, the frame includes a main rod, two pivot seats, two support members, and four posts, the two support members being pivotally connected to the two pivot seats, the two pivot seats having stop portions, each stop portion blocking one of the two support members from pivoting towards the other of the two support members when the frame is in the unfolded state, the two support members are thereby blocked by the stop portions when the frame is in the unfolded state, and in the unfolded state, the four posts are detachably mounted to the two support members respectively, the two support members retained in the unfolded state by the pivoting movement of each support member being limited by the corresponding stop portion and the ball net;

the main rod being a straight strip when the goal is formed, the main rod comprises a connecting seat and two transverse rods, one end of each transverse rod has one of the two pivot seats, another end of each transverse rod has a pivot end, each pivot seat including a base plate and a pair of side plates, the base plate being the stop portion of one of the two pivot seats that blocks the corresponding one of the two support members from pivoting towards the other one of the two support members, the base plate of each pivot seat extending perpendicularly with respect to a longitudinal direction defined by the main rod, the two side plates of each pivot seat being disposed at opposing sides of the corresponding base plate and extending outwardly from the respective base plate, the base plate and the two side plates of each pivot seat together define a groove, the groove having a first open end and a second open end at opposing ends thereof, the groove having an open side in opposing relationship with respect to the base plate, each of the two support members have a first end and a second end at respective opposing ends thereof, the first end being pivotally connected to the opposing side plates of the corresponding pivot seat via the corresponding groove, each support member being pivotable between the first open end and the second open end via the open side, the two support members are pivotable toward the corresponding first open ends whereby each support member is blocked by the corresponding base plate of the pivot seat from contacting the other support member, the two support members thereby extend transversely relative to the main rod when each support member is pivoted towards the corresponding first open end, the two support members are pivotable towards the corresponding second open ends to be aligned with the longitudinal direction of the main rod;

when the two support members are pivoted toward the corresponding first open ends and blocked by the respective base plates of the pivot seats to extend in the transverse direction of the main rod, two of the four posts are disposed at the first ends of the two support members respectively to be located at a rear section of the ball net, the other two of the four posts are disposed at the second ends of the two support members respectively to be located at a front section of the ball net, and the two front posts are tensioned subsequent to the ball net being set for thereby retaining a spacing of the second ends of the two support members relative to one another;

the connecting seat having a rectangular tubular shape, the connecting seat having two opposing first sides and two opposing second sides, one of the two first sides having a first opening at a central portion thereof and having two first stop plates at opposing end portions thereof, the other of the two first sides having a second stop plate at a central portion thereof and having two second openings at opposing end portions thereof;

the pivot end of each transverse rod is inserted into the connecting seat from a corresponding one of the second openings to be pivotally connected to the corresponding second side and extend beyond the first opening, the two transverse rods are pivotable to be parallel to a longitudinal direction defined by the connecting seat and be blocked by respective first stop plates to thereby be in the form of the straight strip, and the two transverse rods are pivotable toward the same side of the connecting seat.

2. The goal frame as claimed in claim 1, wherein the ball net is provided with a plurality of sleeves fitted on the main rod, the two support members, and the four posts, the ball net is provided with an edge strip between top ends of the two front posts to tension the two front posts.

3. The goal frame as claimed in claim 2, wherein the second end of each support member is provided with a front upright pipe, each of the pivot seats at the two ends of the main rod is provided with a rear upright pipe, the two front posts are inserted in the front upright pipes of the two support members to stand at the second ends of the two support members, and the two rear posts are inserted in the rear upright pipes of the two pivot seats to stand at the first ends of the two support members.

4. The goal frame as claimed in claim 1, wherein each side plate has an L shape and has a long portion and a short portion which are connected to each other, the short portion extends along the longitudinal direction of the main rod from a side of the long portion far away displaced from the base plate;

the first end of each support member has an L-shaped pivot block corresponding in position to each side plate of the respective pivot seat, the pivot block of each support member is pivotally connected between the short portions of the two side plates of each pivot seat, when the two support members are pivoted toward the respective first open ends and blocked by the respective base plates, the two support members are extended in the transverse direction with respect to the main rod and when the two transverse rods are pivoted toward the same side of the connecting seat, the two support members are pivoted toward the respective second open ends to be aligned with a longitudinal direction defined by the main rod.

5. The goal frame as claimed in claim 1, wherein each support member has an outer pipe and an inner rod, the inner rod is insertable into the outer pipe from one end of the outer pipe and is retractable with respect to the outer pipe, and the outer pipe and the inner rod are positioned relative to one another by a positioning member when in an extended position.

* * * * *